US011002295B2

(12) United States Patent
Beck et al.

(10) Patent No.: US 11,002,295 B2
(45) Date of Patent: May 11, 2021

(54) FASTENING STRUT FOR A FAN GUARD

(71) Applicant: ebm-papst Mulfingen GmbH & Co. KG, Mulfingen (DE)

(72) Inventors: Sven Beck, Krautheim (DE); Tobias Schmidt, Ahorn-Schillingstadt (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 388 days.

(21) Appl. No.: 15/629,817

(22) Filed: Jun. 22, 2017

(65) Prior Publication Data

US 2017/0370380 A1 Dec. 28, 2017

(30) Foreign Application Priority Data

Jun. 23, 2016 (DE) ..... 10 2016 111 516.9

(51) Int. Cl.
*F04D 29/70* (2006.01)
*F04D 29/60* (2006.01)

(52) U.S. Cl.
CPC ..... *F04D 29/703* (2013.01); *F04D 29/601* (2013.01)

(58) Field of Classification Search
CPC .... F04D 29/601; F04D 29/703; F04D 29/646; F05D 2260/31
USPC ..... 415/121.2
See application file for complete search history.

(56) References Cited

U.S. PATENT DOCUMENTS 2,258,325 A * 10/1941 Hess ..... F04D 29/703 417/359
6,439,852 B1 * 8/2002 Andriotis ..... F04D 29/703 415/121.2
2017/0241441 A1 * 8/2017 Kinkel ..... F04D 25/06

FOREIGN PATENT DOCUMENTS

DE 33 11 660 C2 7/1990
DE 299 00 923 U1 7/2000
DE 10111397 A1 * 9/2002 ..... F04D 29/703
EP 1486679 A1 * 12/2004 ..... F04D 13/021
GB 2004947 A * 4/1979 ..... F04D 29/646

* cited by examiner

*Primary Examiner* — Michael Lebentritt
*Assistant Examiner* — Jesse M Prager
(74) *Attorney, Agent, or Firm* — Dickinson Wright PLLC

(57) ABSTRACT

The present disclosure concerns a fastening strut for a fan guard with at least one first leg extending in a longitudinal direction, configured so as to reach across several cage bars of the fan guard, wherein the at least one first leg comprises a free lengthwise end, and in the region of the free lengthwise end of the at least one first leg a cube-shaped or cuboidal fastening element is secured laterally to the at least one first leg by integral bonding in a transverse direction running perpendicular to the longitudinal direction.

8 Claims, 2 Drawing Sheets

FASTENING STRUT FOR A FAN GUARD

RELATED APPLICATIONS

The present patent document claims the benefit of priority to German Application No. 10 2016 111 516.9 filed on Jun. 23, 2016, the entire contents of which are incorporated herein by reference.

FIELD

The present disclosure concerns a fastening strut for a fan guard as well as a fan guard with at least one fastening strut.

BACKGROUND

Fan guards are used for example in axial fans as protection against touching the blades. They usually comprise a plurality of concentric cage bars spaced apart in the radial direction. Furthermore, the fan guards are often three-dimensional in shape, their radial margin section being formed by cage bars spaced apart primarily in the axial direction. It is also possible to have radially and axially spaced cage bars in order to form slanting courses.

By fastening struts running radially across the cage bars, the cage bars of the fan guard are stabilized and joined together in a firm position. Furthermore, the fan guards are attached via the ends of the fastening struts to the fan or the fan motor. These connection points are subjected to heavy loads, since on the one hand they need to absorb the bending and rotational moments created by the operation of the fan motor and on the other hand the vibrations created during operation. Therefore, the connection point of the fastening strut must have an extremely stable design in order to prevent breakage of the strut or the fastening means.

Prior art for such fastening struts and Fan guards is disclosed for example in DE 299 00 923 U1 or DE 33 11 660 C2.

SUMMARY

The present disclosure ensures a stable and low-cost attachment of the fan guard to fans and fan motors.

According to the present disclosure, a fastening strut for a fan guard is proposed with at least one first leg extending in a longitudinal direction. The at least one leg is configured so as to reach across several cage bars of the fan guard, wherein the at least one first leg comprises a free lengthwise end, and in the region of the free lengthwise end of the at least one first leg, a cube-shaped or cuboidal fastening element is secured laterally to the at least one first leg by integral bonding in a transverse direction running perpendicular to the longitudinal direction. The longitudinal direction of the fastening strut according to the present disclosure means the direction of extension across the plurality the cage bars, which corresponds for example in the case of a round fan guard to a radial direction.

Thanks to the use of a cube-shaped or cuboidal fastening element secured to the free lengthwise end by integral bonding, the load on the at least one leg of the fastening strut is reduced. The fastening element can be designed as a massive metal cube or cuboid, which is much more stable in respect of the leg. Furthermore, the cube-shaped or cuboidal configuration of the fastening element affords a good abutment both for fastening means such as screws and for the connection parts of the fan or fan motor. The integrally bonded connection by welding for example can be produced extremely cheaply. Costly assembly work on the at least one leg, such as fastening sleeves or the like, is eliminated.

In one modification, the fastening strut has a second leg extending in the longitudinal direction substantially parallel to the first leg, while the first and second leg are formed as a single piece of hairpin shape and an open end of the hairpin shape determines the free lengthwise end. The "hairpin shape" is defined as a U-shape having two at least substantially parallel legs, which is closed at one end by a substantially round transition, so that a U-shape results, wherein the respective leg length and curvature of the transition are variable. The fastening element is preferably arranged in the transverse direction between the first and second leg and joined by integral bonding to the first and second leg. The free lengthwise end of the fastening strut is stabilized by the arrangement of the fastening element between the two legs, it enables more absorption of moments at the fastening point of the fan guard, and it assures a longer service life in operation.

In one advantageous embodiment, the fastening element is a solid body with at least one through hole extending in the vertical direction perpendicular to the longitudinal and transverse direction. The through hole is used to lead through a fastening means, such as a screw. Moreover, a configuration is favorable in which the fastening element has opposite plane parallel bearing surfaces in all directions. This improves the integrally bonded connection to the leg or legs, as well as the fastening to the fan or fan motor.

In one modification, the fastening element is larger in dimension in the longitudinal direction by at least a factor of 1.5 than in the transverse direction. This produces longer bearing surfaces along the leg or legs and an additional stability for the leg or legs.

As regards the dimensioning, moreover it is advantageous for the fastening element in one embodiment to be larger in the vertical direction than the leg or legs and thus to stick out in the vertical direction beyond the leg or legs. The vertical direction runs perpendicular to the longitudinal and transverse direction and corresponds in the installed position to the axial direction of the fan or fan motor.

Furthermore, in one variant embodiment of the fastening strut it is provided that the first and second legs run in the transverse direction at a spacing and substantially parallel to each other in the longitudinal direction, and the fastening element is dimensioned in the transverse direction such that it entirely fills up this spacing. The fastening element can also be configured somewhat broader, in order to slightly press the legs outward in the transverse direction.

The leg or legs in one favorable embodiment have a round cross sectional shape. In the region of the free lengthwise end of the fastening strut, the fastening element is arranged so that it is flush with the free lengthwise end of the leg or legs.

The present disclosure moreover comprises a fan guard with at least one, preferably a plurality of fastening struts as described above. Such a fan guard comprises several cage bars, with the at least one fastening strut reaching across them. The free lengthwise end of the fastening strut and the fastening element arranged thereon stick out radially inward beyond the region of the cage bars and provide a point of connection to the fan or fan motor.

All described features may be combined in any desired manner, so far as this is technically feasible and does not present a contradiction.

Other advantageous modifications of the present disclosure are characterized in the subclaims or presented more closely below in connection with the description of the preferred embodiment of the present disclosure with the help of the figures. There are shown:

BRIEF DESCRIPTION OF THE DRAWINGS

The same reference numbers designate the same parts in all views.

DETAILED DESCRIPTION OF SPECIFIC EMBODIMENTS

Figure 1:
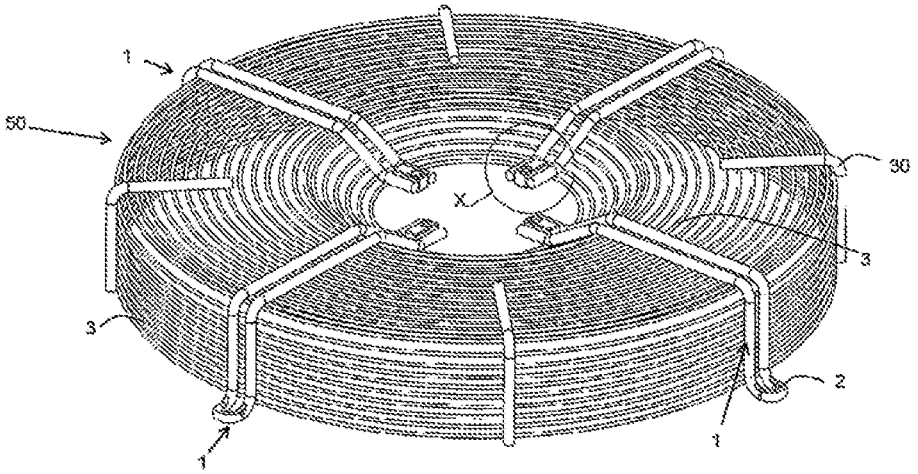
FIG. 1, a fan guard in a perspective view.

FIG. 1 shows a fan guard 50 with a plurality of encircling cage bars 3 in a perspective view. The fan guard 50 has four fastening struts 1 distributed in the circumferential direction for mounting on a fan, between which shorter single-leg stiffening struts 30 are arranged, looking in the radial direction. The fastening struts 1 reach across all cage bars 3 and each time have a free lengthwise end at their radially inwardly lying sections. The configuration of the fastening strut 1 in this region is shown more closely in the detail view X in FIG. 3. Each of the fastening struts 1 is formed by two legs 11, 12, running in a hairpin shape. In the radially outward lying region of the fastening struts 1, the closed U-shaped section 2 sticks out radially beyond the fan guard 50 and provides a connecting point. The shape of the fastening strut 1 is adapted to the trend of the cage bars 3, so that the fastening struts 1 an outer section running substantially vertically, a radially running section adjoining the latter, and a slanting section adjoining the latter. Next to the slanting section is the free lengthwise section 5, in which the fastening struts run straight in the radial direction.

Figure 2:
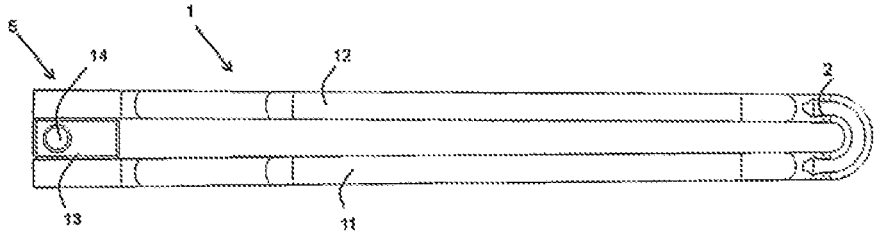
FIG. 2, a fastening strut of the fan guard from FIG. 1 in top view.
Figure 3:
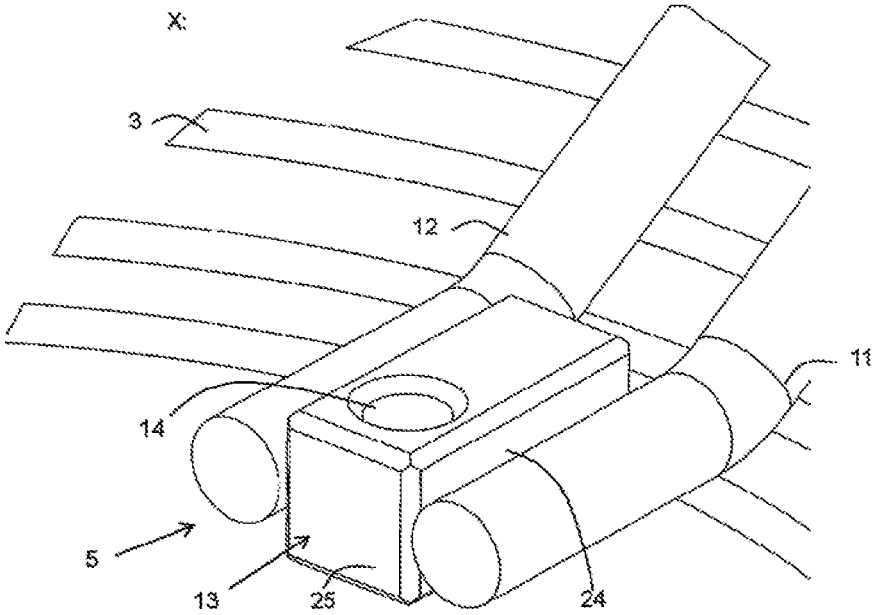
FIG. 3, a detail view X from FIG. 1.

Referring to FIGS. 2 and 3, a fastening strut 1 is shown in further detail. The longitudinal direction of the fastening strut 1 runs from the closed section 2 to the free lengthwise end 5. Looking in the transverse direction perpendicular to this, a cuboid 13 made of solid material as arranged between the two legs 11, 12 as a fastening element and it is connected by integral bonding, such as through welding or soldering, to the two legs 11, 12. The edges of the cuboid 13 are provided with chamfers. Looking in the transverse direction, a through hole 14 is made in the cuboid 13, by which the fastening strut 1 can be secured by a fastening means such as screws. The side surfaces 24, 25 of the cuboid 13 are planar in all directions. At the front side, the cuboid 13 is flush with the free ends of the legs 11, 12. In the vertical direction, the cuboid 13 sticks out beyond the legs 11, 12, which are round in cross section. The dimensioning of the cuboid 13 in the longitudinal direction corresponds to the free lengthwise section 5 in which the legs 11, 12 of the fastening strut 1 run straight in the radial direction. The cuboid 13 looking in the longitudinal direction has twice the length of a width looking in the transverse direction. Its height in the vertical direction corresponds to the width.

The invention claimed is:

1. A fan guard comprising:

a plurality of spaced-apart cage bars defining a radial inner side and a radial outer side of the fan guard;

a fan strut having a first leg and a second leg extending in a longitudinal direction and configured so as to reach across several cage bars of the plurality of spaced-apart cage bars;

the first leg having a round cross-sectional shape and including a free lengthwise and extending in the longitudinal direction and sticking out beyond the plurality of cage bars at the radial inner side of the plurality of cage bars, the free lengthwise end defining an upper surface opposite of a lower surface, and a first lateral side surface located between the upper and lower surfaces;

the second leg having a round cross-sectional shape including a free lengthwise end extending in the longitudinal direction and sticking out beyond the plurality of cage bars at the radial inner side of the plurality of cage bars, the free lengthwise end of the second leg defining an upper surface opposite a lower surface, and a second lateral side surface located between the upper and lower surfaces and facing the first lateral side surface; and in the region of the free lengthwise end of the first and second legs, a cuboidal fastening element secured to the first and second lateral side surfaces of the first and second legs by integral bonding such that the fastening element extends from the first and second legs in a transverse direction running perpendicular to the longitudinal direction;

wherein the fastening element is larger in a vertical direction running perpendicular to the longitudinal and transverse directions than the first and second legs, and the fastening element sticks out in the vertical direction beyond both of the upper and lower surfaces of the first and second legs.

2. The fan guard according to claim 1, wherein the first and second legs are formed as a single piece of hairpin shape and an open end of the hairpin shape defines the free lengthwise ends of the first and second legs.

3. The fan guard according to claim 2, wherein the fastening element is arranged in the transverse direction between the first and second legs such that the fastening element is flush with the free lengthwise ends of each of the first and second legs.

4. The fan guard according to claim 1, wherein the fastening element is a solid body with through hole extending in the vertical direction perpendicular to the longitudinal and transverse direction.

5. The fan guard according to claim 1, wherein the fastening element has opposite plane parallel bearing surfaces in all directions.

6. The fan guard according to claim 1, wherein the fastening element is larger in dimension in the longitudinal direction by at least a factor of 1.5 than in the transverse direction.

7. The fan guard according to claim 2, wherein the first and second legs are spaced apart in the transverse direction, and the fastening element is dimensioned in the transverse direction such that it entirely fills up the spacing between the free lengthwise ends of the first and second legs.

8. The fan guard according to claim 1, wherein the fastening element is flush with the free lengthwise end of the first leg.

* * * * *